US009821482B2

(12) United States Patent
Ranfelt

(10) Patent No.: US 9,821,482 B2
(45) Date of Patent: Nov. 21, 2017

(54) CUTTING TOOL

(71) Applicant: BERNT RANFELT APS, Viby J (DK)

(72) Inventor: Bernt Balle Ranfelt, Højbjerg (DK)

(73) Assignee: BERNT RANFELT APS (DK)

( * ) Notice: Subject to any disclaimer, the term of this patent is extended or adjusted under 35 U.S.C. 154(b) by 129 days.

(21) Appl. No.: 14/601,822

(22) Filed: Jan. 21, 2015

(65) Prior Publication Data

US 2015/0202784 A1 Jul. 23, 2015

(30) Foreign Application Priority Data

Jan. 21, 2014 (DK) ..... 2014 70027
Jun. 27, 2014 (DK) ..... 2014 70400

(51) Int. Cl.
*B26B 29/00* (2006.01)
*B26B 3/08* (2006.01)

(52) U.S. Cl.
CPC ..... *B26B 29/00* (2013.01); *B26B 3/08* (2013.01)

(58) Field of Classification Search
CPC B26B 29/00; B26B 3/08; B26B 5/005; B26B 5/006; A41H 31/005
USPC ..... 30/286, 283, 288, 289, 294, 287
See application file for complete search history.

(56) References Cited

U.S. PATENT DOCUMENTS 893,588 A * 7/1908 Hughes ..... B26B 5/005 30/287
2,764,814 A 10/1956 Jecker
3,100,935 A 8/1963 Hargrave
4,198,751 A 4/1980 Egbert
6,195,896 B1 3/2001 Ireland
6,240,645 B1 * 6/2001 Ozeki ..... A41H 31/005 30/240
6,371,844 B1 * 4/2002 Holler ..... A22B 5/0094 452/106
2005/0044726 A1 * 3/2005 Summers ..... B26B 5/001 30/294
2007/0175308 A1 8/2007 Shah
2009/0071012 A1 3/2009 Shan et al.
2011/0119931 A1 5/2011 Clearman
2011/0308093 A1 12/2011 Samples et al.
2012/0017450 A1 * 1/2012 Hetts ..... B26B 5/005 30/315

FOREIGN PATENT DOCUMENTS

DE 20005519 U1 6/2000
DE 202010001338 U 4/2010
FR 2604650 A 4/1988
GB 369754 A 3/1932
GB 899488 A 6/1962

OTHER PUBLICATIONS

European Search Report dated May 21, 2015; EP 1515 2005; 2 pgs.

* cited by examiner

*Primary Examiner* — Omar Flores Sanchez
(74) *Attorney, Agent, or Firm* — Schmeiser, Olsen & Watts, LLP

(57) ABSTRACT

A cutting tool with handle and a cutting member that includes a feed slot with a cutting blade and a guiding member with a discus-like shape formed by two opposing convex surfaces is provided. The cutting blade is arranged on one convex surface leading the material to be cut into the slot to the cutting blade. The tool handle extends substantially parallel with the plane containing the at least one cutting blade in order to improve the manual control of the tool by pulling or pushing.

20 Claims, 11 Drawing Sheets

CUTTING TOOL

CROSS-REFERENCE TO RELATED APPLICATIONS

This application claims priority to DK Application No. PA 2014 70027, having a filing date of Jan. 21, 2014, and DK Application No. PA 2014 70400, having a filing date Jun. 27, 2014, the entire contents of which are hereby incorporated by reference.

FIELD OF TECHNOLOGY

The following relates to a cutting tool with a handle and with a cutting blade that is provided in a feed slot in which material is cut when the tool is manually moved relatively to the material such that the material is passed through the feed slot. The invention also relates to a method for using the cutting tool.

BACKGROUND

The following has been made in connection with removal of nets from Christmas trees. That is the process performed when a Christmas tree is packaged in a net and has to be unpacked for transportation. This unpacking or removal of nets is made by cutting the net that holds the branches toward the tree stem by an elastic force.

So far, this has typically been done by using a pair of scissors. Alternatively, also knives, such a hobby knives, have been tried. However, there have been disadvantages in both methods. When using scissors, there is a risk that the scissors get stuck in the tree branches. Furthermore, there is a risk that the scissors damage the tree branches, because not only the net is cut but there is also a risk of cutting off the branches. When using knives, there is a risk of damaging the tree and injuring the user. Furthermore, the use of a knife can be difficult because the net is not held in tension with equal force due to an irregular geometry of the tree. This means that, in addition to the risk of damaging the tree with a knife, there is also a risk that the net is only "pushed" by a knife.

During transport of Christmas trees from the forest to a point of sale, it is common that the trees are wrapped in nets. In order to present the trees for sale, it is therefore necessary remove the nets from the Christmas trees in order for user having the possibility to see and evaluate the individual trees. After purchase, the tree will again be packed into a net for transport the user's home where the net will have to be removed as well. In both situations, there is a need for an efficient tool that overcomes the disadvantages mentioned above. In the two situations, a need can be defined for a professional tool and the need for a do-it-yourself tool.

Besides the removal of nets from Christmas trees, cutting tools are used in other forms of unpacking of packed products. Thus, there is also a need for tools for removal of bands or the like from a packaged product but where a protection is also desired against damage to the packaged product during the cutting or shearing of the band or net that is used for packaging the product.

In the prior art, various cutting tools are disclosed, wherein the material to be cut is fed into a cutting slot, in which there is provided a cutting blade. In this way, for example, fabric is cut without damaging the underlying material. Examples are disclosed in the patent documents FR2604650, GB369754, GB899488, U.S. Pat. No. 2,764,814, U.S. Pat. No. 3,100,935, U.S. Pat. No. 4,198,751, U.S. Pat. No. 6,240,645, US2009/0071012, US2011/0308093.

None of the cutting tools in these publications are particularly suitable for removal of nets from Christmas trees, as, in this connection, these cutting tools do not work much better than an ordinary pair of scissors and easily catches the tree branches during the cutting.

Thus, it has been found that there is a need for an improved tool that can eliminate the risk of damaging the packaged product and at the same time ensures an efficient and easy cutting of the packaging, for example in the form of a net or band. The design must also ensure that users do not cut themselves by the knife Also within the sector of animal slaughtering, there is a need for an improved cutting tool that, on the one hand, is efficient in cutting animal skin and, on the other hand, minimizes the risk of damage to the underlying tissue. Also, in this case, the above-described tools of the prior art do not appear advantageous.

SUMMARY

An aspect relates to a cutting tool of the initially mentioned type which overcomes these disadvantages. The tool is simpler and has higher reliability than the tools in the prior art.

This aspect is achieved according to embodiments of the present invention with a cutting tool comprising a handle and a cutting member as described in the following.

The cutting member for cutting a material comprises a feed slot with a cutting blade such that the material inserted into the feed slot is cut by the cutting blade. For example, the feed slot is partially enclosed by the cutting blade. Alternatively, the cutting blade cooperates with a counter-cutting blade or with a counter-member opposite to the cutting blade such that the material inserted into the feed slot is pressed against the cutting blade by the counter-member. For example, two cutting blades are used for cutting in co-operation and being positioned with an acute angle between them, leading to cutting of the material from two sides when inserted into the feed slot.

In addition, the cutting member comprises a guiding member which guides the material into the feed slot during the cutting process. The guiding member is provided with two opposite convex surfaces that are provided on either side of a center plane through the guiding member. The guiding member has a discus-like shape formed by the two convex surfaces. With the term discus-like is meant a relatively flat structure, for example oval structure. For such a flat structure in which the length and width and thickness varies across the discus-like form, the greatest width and greatest length are considerably larger than the greatest thickness of the discus, such as several times larger than the maximum thickness, for example at least two or three times the maximum thickness. Such a discus-like structure is formed by two convex surfaces that are smoothly curved in the sense that they do not have steps or sharp bends in the surface. The center plane is perpendicular to the plane of the cutting blade such that a material, for example a net, during the cutting process is stretched on the convex surface, and during sliding motion on the convex surface is guided in a planar fashion into the feed slot and into the cutting blade, which is perpendicular to the material during the cutting process, where the tool is moved relative to the material in a cutting direction.

During the cutting process, where the tool is moved in a cutting direction relatively to the material, the guiding member is in front of the cutting blade. The center plane of the guiding member is typically parallel with the cutting direction, although, a small angle to the cutting direction is also possible, as the convex surface in any case provide for guiding the material into the feed slot.

The two convex surfaces can but need not be symmetrical about the center plane. The two convex surfaces that form the discus-like shape will generally not have a circular shape.

The two convex surfaces are each bounded by a curved front edge and a rear edge that is, optionally, a curved edge or a rectilinear edge. For example, the curved front edges are approximately semi-circular or semi-oval. If the rear edge is curved, it is also advantageously semi-circular or semi-oval. At least the front curved edges are joined together so as to form the discus-like surface structure.

The cutting blade is arranged on that one of the convex surfaces that leads the material to be cut into the feed slot to the cutting blade. For example, in the upper side of a first of the convex surfaces, there is provided a recess in which the at least one cutting blade is arranged in a way such that it extends from the first convex surface and is oriented with its cutting edge towards the guiding member's front end. If the tool is oriented with the cutting blade above of the guiding member, the insert thus extends above the convex surface.

The tool is further provided with a handle that extends parallel or substantially parallel with the plane that contains said at least one cutting blade. This facilitates control of the tool when manually pulling or pushing. If the tool is oriented with the cutting blade above the guiding member, the handle is advantageously positioned such that it also extends above the second convex surface.

As used herein, the terms "front" and "rear" relate to the manual movement of the tool when used for cutting of nets or other sheet material by the at least one cutting blade. This way, the front end of the guiding member would be that point which is at the lead during the cutting action. There are also used the term "above" that refers to that side where the cutting blade is provided relatively to the guiding member when the central plane is horizontal. The term "underneath" refers to that side of the guiding member which is opposite to the cutting blade and therefore also on the opposite side of the center plane.

As the handle extends above the second convex surface and does not protrude downwards and out of the second surface, it is ensured that the handle will not collide with the packaged product when the packaging is cut. It should be noted in this connection that the tool not only can be used for packaging nets of Christmas trees but also may find other uses, which include cutting of bands or ribbons, cardboard, paper, leather and textiles.

Furthermore, it is an advantage if the handle is also located at a position above the first convex surface where the cutting blade is disposed. This provides a good balance of the tool.

The handle may be located at a position in front of, next to, or behind the location of the at least one cutting blade. It has been found in certain cases advantageous that the handle is disposed at a position more or less next to the at least one cutting blade and, thus, in a position above the first convex surface.

With such a tool, the guiding member's convex surfaces will provide a protection of the product; and the sliding of the net over the convex surface provides a secure guidance and tightening of the net into the feed slot.

The tool's guiding member is inserted between the product and the packaging, for example, between a tree and a net.

The convexity of the first convex surface cause a net being stretched when conveyed across the first convex surface, which has a progressive width. The curved front edge ensures that the tool does not entangle with the meshes of the net.

The convexity of the second surface provides a protection of the packaged product. Furthermore, the convexity of the second surface also causes the tool not becoming stuck in the packaged product at the position of the cutting. This is, especially, an advantage in connection with trees from which the net is to be removed.

In the case of a tree, there is no risk for the tool getting caught by the branches because of the special curved edge, which is directed forwards during use.

When the mesh or band is conveyed over the curved front edge of the convex face there occurs a stretching. When the net or band reaches the recess, which is typically disposed in a most rear portion of the guiding member, the net or band is conveyed into the feed slot between the cutting blade and the counter-cutting blade or counter-member or between the two cooperating cutting members, as the cutting edge extends above the first convex surface, that is, extends from the convex surface. As the cutting blade is at an acute angle, the net will be cut due to the tensioning and due to the acute angle, without the risk of the net getting stuck on the cutting blade.

The first convex surface will cause stretching of the net, and the cutting member will be located at a position at the rear part of the two convex surfaces.

In some embodiments, there is a distance between the two convex surfaces at that rear part, which provides the guiding member with a certain height so that the handle can be located in a way that it is not projecting below the guiding member. This way, only the cutting blade protrudes above the first convex surface; or the handle can be mounted such that it is protruding above the first convex surface in a position behind the cutting blade. The cutting blade is oriented towards the front end of the guiding member such that a guided movement of the tool will cause a movement of the cutting edge in the plane of the cutting blade and, hence, parallel with the longitudinal extent of the cutting blade.

The tool handle is parallel with the plane of the cutting blade such that it also has an orientation parallel with the direction of conveyance.

In the case in which the tool handle is at a rear end of the convex surfaces of the tool, the net or the like will be cut at a position in front of the handle. Thus, there will also not be a risk that the net, band or the like gets stuck in the handle. The handle will advantageously be located in a position that does not extend under the second convex surface which is directed towards the tree. Thus, no part of the tool handle is at risk of interfering with branches or similar and prevent a free and unhindered movement of the tool. The tool's handle will advantageously be located near the feed slot and the cutting blades in order to create the best balance of the tool and least twisting of the wrist of the user during the cutting operation.

The height of the inlet opening of the feed slot will be determined based on safety concerns, so that no a hand or finger is put into the feed slot. Therefore, the feed slot typically has a height of less than 18 mm at the inlet opening.

The tool according to embodiments of the invention is suitable for unpacking of packed products where the packing material can be net, plastic, paper, cardboard, textiles, cord, band, ribbon, leather, etc.

The tool according to embodiments of the invention is likewise suitable for slaughtering of animals, preferably for cutting the animal's skin.

According to a further embodiment, the tool according to the invention is peculiar in that the two cutting blades are maintained at a constant angle between them. Thus, there may be used cutting blades in which the cutting action is achieved by manual movement of the tool.

According to a further embodiment, the tool according to the invention is peculiar in that the two cutting blades are placed in a holder that comprising a holder part and a handle portion that serves as the tool handle. Thus, the cutting blades can be replaced in the holder part, or alternatively, the holder part is replaced when the cutting blades are worn. Thus, it is not necessary to discard the entire tool. Alternatively, also the holder part and the handle portion form a replaceable unit. This may be an advantage, especially, in a construction in which the cutting edges are embedded by molding in an element that constitutes handle and holder part.

The holder of the cutting blades can be replaced by loosening screws if the holder part is screwed onto the handle portion. Alternatively, the holder part may also be secured in the handle portion by a so-called snap-lock. An example of a snap-lock is holding a member by a hook which engages behind an edge in which either the hook or the edge is provided flexibly displaceable laterally to the edge; typically, the edge is pushed relatively to the hook, resulting in a snap-locking action with a click sound when the edge and hook get into mutual engagement, from which the term snap-lock is derived. Thus, the holder part can be made of a plastic part with embedded cutting edge, which forms the insertion angle of the tool. This allows a holder part of the cutting blades to be produced simple and easily replaceable when the cutting blades are worn out.

According to a further embodiment, the tool according to the invention is peculiar in that the two cutting blades are movable relatively to each other. This provides greater security for the cutting of the net or band. The movement can be a mutual swing as known from scissors, or a rotation.

According to a further embodiment, the tool according to the invention is peculiar in that one cutting blade is rotatable relatively to the second cutting blade and that the cutting blade is driven by a motor, the housing, for example, serving as the tool handle. This tool ensures an efficient cutting and restricts the conveying force that a user must apply for cutting. Therefore, this embodiment is especially suitable for professional use, for example, where it is necessary to remove nets from many Christmas trees.

Alternatively, the handle may include a handle portion that is mounted above the house of the engine, for example by two mounting pins. The location of the handle portion above the house provides a good balance in the tool. This way, a twist in the user's hand is reduced. The handle portion may be solid or hollow.

According to a further embodiment, the tool according to the invention is peculiar in that the rotary cutting blade has a polygonal shape and cooperates with a fixed straight counter-cutting blade. Hereby, cutting may be achieved by co-operation of the two straight cutting blade portions with an acute angle between the two cutting blade portions.

According to a further embodiment, the tool according to the invention is peculiar in that the convex surfaces have rounded corners between the curved front edges and the rear edges. This reduces the risk of the tool getting caught by the material to be cut, or in the surrounding material.

According to a further embodiment, the tool according to the invention is peculiar in that the two convex surfaces have a maximum width of between 20 mm and 250 mm, for example between 100 mm and 250 mm, and a maximum length of between 30 mm and 300 mm, for example between 75 og 250 mm, and a maximum height of between 10 mm and 50 mm when measure between the convex surfaces at the largest distance between the convex surfaces. It is a particularly advantageous size for the tools to be used for removal of nets from Christmas trees, if the width is more than 100 mm. If the tool is to be used for other package materials, a narrower and shorter tool is advantageous.

In certain embodiments, which are for other applications, for example in the field of slaughtering, such as for cutting animal skin during slaughtering, the convex surfaces have a width and length between 10 mm and 30 mm, for example between 10 mm and 20 mm. Thus, the guiding member is relatively small.

According to a further embodiment, the tool according to the invention is peculiar in that the handle does not extend under the second convex surface. This reduces the risk of the tool getting caught in the packaged product, as only the tool's second convex surface will be in contact with the product.

According to a further embodiment, the tool according to the invention is peculiar in that the handle is disposed substantially or completely above the feed slot. This gives a good balance for avoiding twisting of the wrist during the cutting operation. For example, the cutting blade is provided between the guiding member and the handle.

According to a further embodiment, the tool according to the invention is peculiar in that it is provided with a further knife member, which is arranged without co-operation with said cutting member. Such a knife member could be used to cut a hole in the packaging, for example a net, after which the guiding member can be placed in a position between the product and the packaging (the net). In the case where the tool is used for slaughtering, the knife member can be used for the initial cutting of the animal, for example the abdomen, after which the cutting blade is used for further cutting of the skin without damaging the parts of the animal underneath the skin. In particular, it is important that the intestines are not damaged during the cutting of the animal skin at the abdomen.

In some embodiments, the handle is elongate, and the further knife member is an elongate knife blade in extension of said elongate handle. The knife blade is provided with a cutting knife edge and has a front end farthest away from the handle and an opposite end that is attached to the handle. The guiding member is provided at a side that is opposite the cutting knife edge, for example, at a blunt edge of the knife blade opposite the cutting knife edge. For example, the guiding member is provided on a holder part, and there is provided a cutting blade extending at an acute angle from this side in an oblique direction away from the front end of the knife blade, for example obliquely from a tip of the knife blade at its front end. For example, there is formed a feed slot between the guiding member and the handle.

If the tool has a rectilinear rear edge, a recess at the center of the rectilinear edges only extends through the first convex surface. There is only need for the cutting blade extending above the first convex surface, while the other convex surface is preferably continuous, as the risk of getting caught in the packaged product is hereby reduced.

Aspects

The following describes aspects of the tool in short form.

Aspect 1: A cutting tool, preferably for removal of nets from Christmas trees, and of the type comprising a handle and a cutting member for cutting or shearing a net or band used for packaging a product, wherein the cutting member comprises:

a feed slot enclosed by a curved cutting blade or two cutting blades which, by their cutting effect are placed with an acute angle between them, and a guiding member with two convex surfaces, each of which is bounded by a curved edge and a substantially rectilinear edge, wherein the curved edge is approximately semi-circular or semi-oval, wherein the curved edges are interconnected, wherein in the middle of the rectilinear edge, there is a recess in which the cutting blades are arranged such that they extend above a first convex surface and with the cutting blades oriented substantially perpendicular to the rectilinear edges, and wherein the tool handle extends generally perpendicular to the rectilinear edges with an orientation away from the convex surfaces.

Aspect 2: A cutting tool, preferably for removal of nets from Christmas trees, and of the type comprising a handle and a cutting member for cutting or shearing a net or band used for packaging a product, wherein the cutting member comprises:

a feed slot which is enclosed by a cutting blade that co-operates with a counter-cutting blade or a counter-member, or two cutting blades for cutting in cooperation and being positioned with an acute angle between them, a guiding member with two convex surfaces, each of which is bounded by a curved front edge and a rear edge that is optional a curved edge or a rectilinear edge, wherein the curved edges are approximate semi-circular or semi-oval, wherein at least the front curved edges are interconnected, wherein a recess is provided in the upper side of a first of said convex surfaces in which the at least one cutting blade is arranged such that it extends above the first convex surface, wherein said at least one cutting blade is oriented with its cutting edge oriented towards the front end of the guiding member, and wherein the tool handle extends generally parallel with the at least one cutting blade and extends above the other convex surface.

Aspect 3. A cutting tool according to aspect 1 or 2, wherein the two cutting blades are fixed at the angle that they have between them.

Aspect 4. A cutting tool according to aspect 3, wherein the two cutting blades are placed in a holder comprising a holder part and a handle portion that serves as the tool handle.

Aspect 5. A cutting tool according to aspect 1 or 2, wherein the two cutting blades are movable relatively to each other.

Aspect 6. A cutting tool according to aspect 5, wherein one cutting blade is rotatable relative to the second cutting blade, and the cutting blade is driven by a motor, the housing of which serves as the tool handle.

Aspect 7. A cutting tool according to aspect 6, wherein the rotary cutting blade has a polygonal shape and cooperates with a fixed rectilinear counter-cutting blade.

Aspect 8. A cutting tool according to any one of the preceding aspects, wherein the convex surfaces comprises rounded corners between the curved front edges and the rear edges.

Aspect 9. A Cutting tool according to any one of the preceding aspect, wherein the two convex surfaces have a maximum width of between 20 mm and 250 mm, preferably between 100 mm and 250 mm, and a maximum length between 30 mm and 300 mm, preferably between 75 and 250 mm, and wherein the greatest height is between 10 mm and 50 mm when measured at the largest distance between the convex surfaces.

Aspect 10. A cutting tool according to any one of the preceding aspects, wherein the handle is positioned substantially above the feed slot Aspect 11. A cutting tool according to any one of the preceding aspects, wherein a further knife member is provided without co-operation with the cutting member.

BRIEF DESCRIPTION

Some of the embodiments will be described in detail, with reference to the following figures, wherein like designations denote like members, wherein.

DETAILED DESCRIPTION

Figure 1:
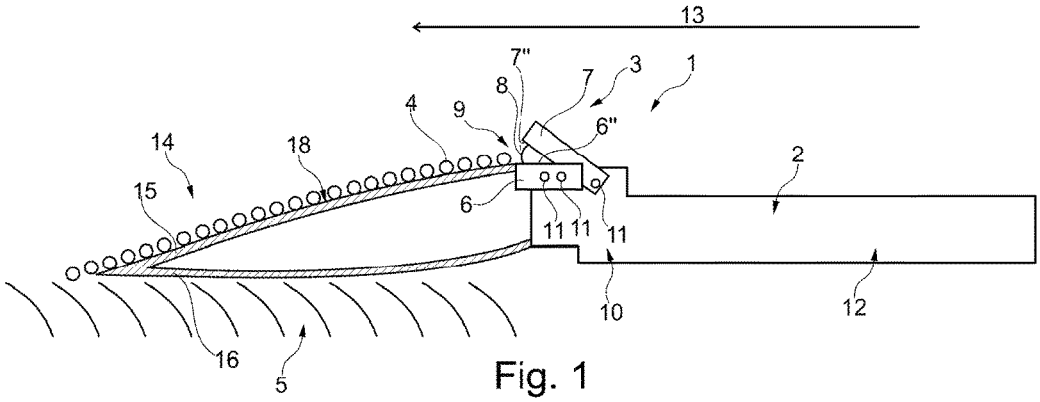
FIG. 1 shows a first embodiment of a tool.

In the different figures, identical or corresponding elements will be designated by the same reference numerals. There will, therefore, not be given a specific explanation for each element in connection with each single embodiment.

FIG. 1 shows a cutting tool 1 comprising a handle 2 and a cutting blade 3 for cutting through a net 4 that is used for packaging of a Christmas tree 5 in such a way that the branches are kept resiliently pressed together.

The cutting member 3 comprises two cutting blades 6,7, each having a cutting edge 6", 7". Thus, there is formed an feed slot 9 with an insertion angle 8 between the two cutting blades 6,7, where the net or other material is inserted for cutting by the two cutting blades 6,7. The handle 2 comprises a holder part 10 in which the cutting blades 6,7 are fastened by screws 11. These screws 11 can be arranged such that the cutting blades 6,7 are replaceable. As an alternative to the fastening by screws 11, the holder part can 10 can be mounted by elements that engage by a snap-action with other holding elements of the handle 2. Thus, a holder part into which the cutting blades 6,7 are embedded by molding can easily be replaced by using such snap action. An example of a snap-action is a restraint of an element by means of a hook that engages behind an edge, wherein either the hook or the edge is provided flexibly displaceable laterally to the edge.

The handle 2 further comprises a handle portion 12 that makes it possible for the user to hold the tool. The handle portion 12 has an orientation parallel to the arrow 13, which is in a cutting direction, which is also the orientation of the cutting blades 6,7.

The cutting member 3 further comprises a guiding member 14. The guiding member 14 comprises a first convex surface 15. Appearing more clearly from FIG. 3, the first convex surface 15 has a recess 17 for receiving the cutting blades 6,7. As is apparent from FIG. 1, the surface 18 of the first convex surface 15 is located a little higher than the upper surface of the cutting blade 6. Thereby, the net 4 will be conveyed into the feed slot 9 without hindrance when it slides over the first convex surface 15. Because of the convexity of the surface 15, there will be a stretch in addition to the one that already result from the contractive force of the net around a tree. Thereby, the net will be kept very tight when it is fed into the slot, which eases the cutting.

Figure 3:
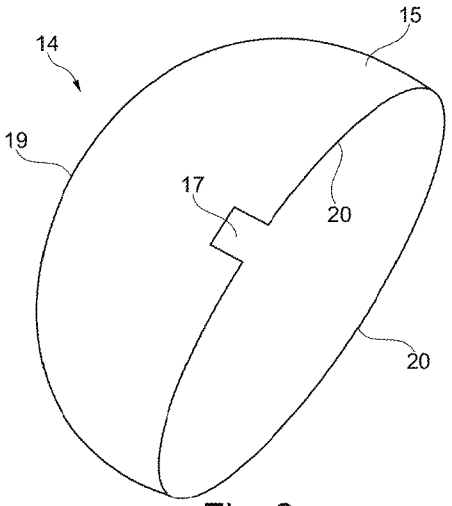
FIG. 3 shows a perspective view of a first embodiment of a guiding member for use in the tool.

As it more clearly appears in FIG. 3, the guiding member 14 has a curved front edge 19 and a substantially rectilinear rear edge 20, where the recess 17 is located in the first convex surface 15. As seen from above, the guiding member 14 is approximately semi-circular or shaped as part of an oval. This appears especially clearly from FIG. 5-7, which illustrate different possible curved shapes for the guiding member 14.

Figure 2:
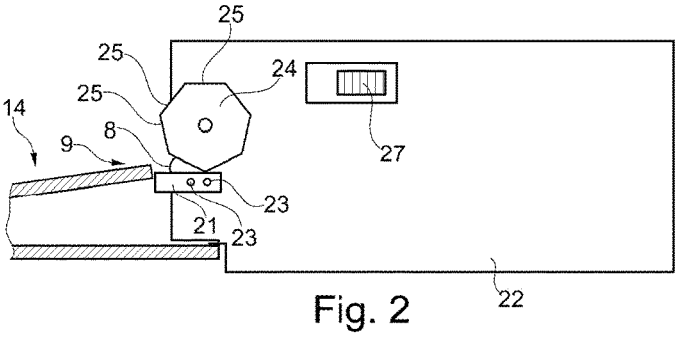
FIG. 2 shows a partial view of another embodiment of a tool.

In FIG. 2, a counter-cutting blade 21 is seen held in a housing 22 by screws 23. A second cutting blade is provided in the form of a rotational disc 24. The rotating disk interacts with the counter-cutting blade 21. The rotational disk 24 is polygonal, thus, having a number of rectilinear cutting blades 25. Each of these cutting blades 25, form an acute angle 9 with the counter-cutting blade 21, ensuring the cutting of the net not only by the acute angle but also by the rotation, so that the net is cut effectively by the rotation of the knife 24. The activation is done by a switch 27 that is located on the housing 22. The housing 22 contains a motor and possibly batteries in case of battery-powered tool. Thus, the housing 22 functions as a handle for the tool. FIG. 2 shows the lower surface of the housing 22 extending below the lower surface of the second convex surface 16. However, it is preferred that the lower surfaces are in the same plane, as shown in FIG. 1.

Figure 4:
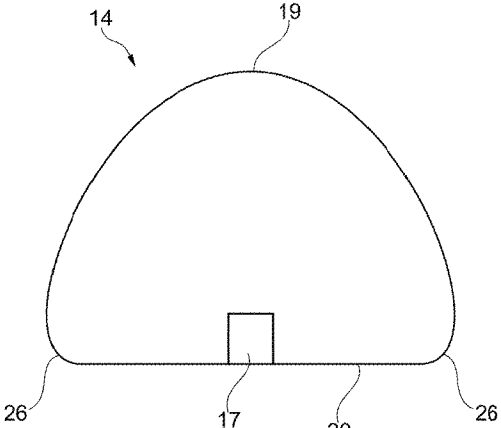
FIG. 4 shows a view of another embodiment of a guiding member for use in a tool.

FIG. 4 shows an embodiment of the guiding member 14 differing slightly from the one that is shown in FIG. 3. The guiding member 14 in FIG. 3 is provided with rounded corners 26 at the transition between the curved edge 19 and the rectilinear edge 20. This ensures that there is no risk for the net getting caught, if it is necessary to make a rearward pull of the tool during use.

Because of the tool's curved front edge, insertion between the net 4 and the tree 5 will occur automatically. Because of the curved shape, the guiding member 14 will ensure that the tool is not caught by the net or the branches. At the same time, the convex shape leads to a stretching of the net so as to more securely hold it tightly during the cutting by the cutting blades.

Figure 5:
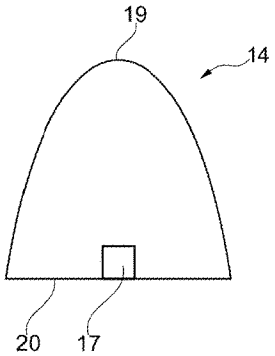
FIG. 5 shows a view of a further embodiment of a guiding member for use in a tool.
Figure 6:
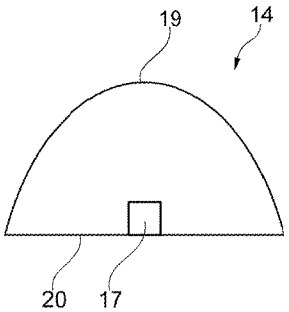
FIG. 6 shows a view of a further embodiment of a guiding member for use in a tool.
Figure 7:
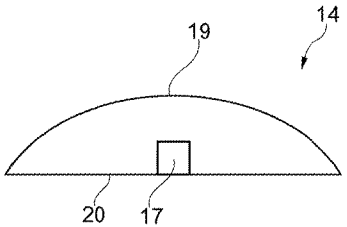
FIG. 7 shows a view of a further embodiment of a guiding member for use in a tool.

FIGS. 5-7 illustrate various forms of the guiding member 14. Thus, FIGS. 5 and 7 show curved edges 19. These are formed as part of an oval, either at the tip or along an elongate side. FIG. 6 shows a curved edge 19 that has the shape approximately as a semi-circle.

Figure 8:
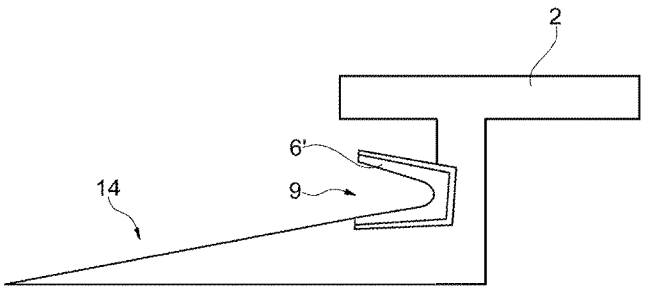
FIG. 8 shows another embodiment of a tool.

FIG. 8 shows an alternative embodiment of a cutting tool 1. In this figure, the cutting tool is shown schematically. This figure serves to illustrate that the handle 2 can be located at a position immediately above the feed slot 9. Further, this embodiment shows a curved cutting blade 6' extending as a smooth arc. The cutting blade 6' is substantially shaped as a parabola that partially surrounds the feed slot 9. With this configuration, wherein the handle 2 is located above the feed slot 9, less twisting of the arm is achieved when the user is applying the cutting tool 1.

Figure 9:
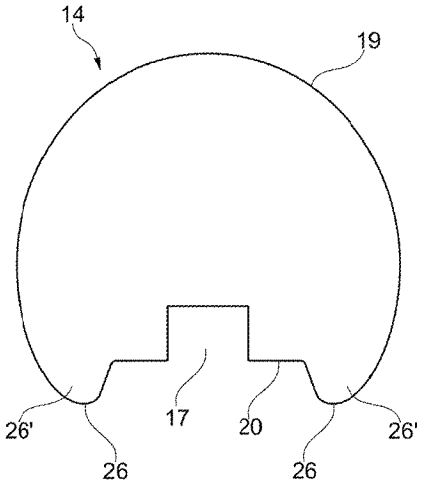
FIG. 9 shows a top view of a third embodiment of a guiding member for use in a tool.

FIG. 9 shows a side view of a third embodiment of guiding member 14. Unlike the guiding member 14 of FIG. 4, the roundings 26 connecting the curved front edge 19 with the rectilinear rear edge 20 are retracted relatively to the rectilinear rear edge 20. This gives rise to two rearwards directed areas 26'. These areas 26' reduce the risk of the tool getting stuck when it is retracted when used for cutting of a net. By the rounding 26 with the retracted edges 20, some kind of "protection" is achieved that ensures that cut parts of the net located on either side of the tool are conveyed along the outer side and will not get stuck, in contrast to the case with a sharper transition between the rectilinear rear side 20 and the curved front edge 19.

Figure 10:
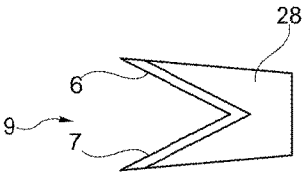
FIG. 10 shows a side view of a further embodiment of inserts for use in a tool.

FIG. 10 shows a holder part 28 which by means of holding elements, for example, snap-members (not shown), may be inserted, for example snapped, into a holder part in the handle portion. In the holder part 28, two straight cutting edges 6,7 are embedded by molding, thus, forming the feed slot 9.

Figure 11:
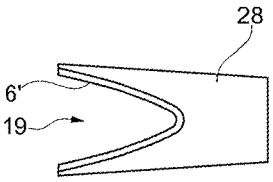
FIG. 11 shows a side view of a further embodiment of inserts for use in a tool.

FIG. 11 corresponds to FIG. 10, apart from the holder part 28 being provided with a curved cutting edge 6' similar to that one of FIG. 8. The cutting blade 6' partially surrounds the feed slot 9. The holder part 28 is also designed to be fixed by holding elements, for example by a snap-action.

Figure 12:
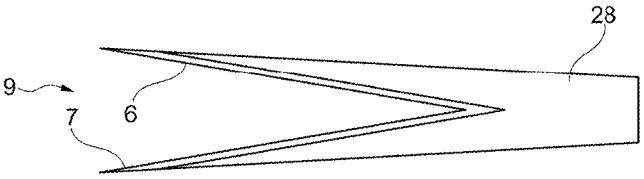
FIG. 12 shows a side view of a further embodiment of inserts for use in a tool.
Figure 13:
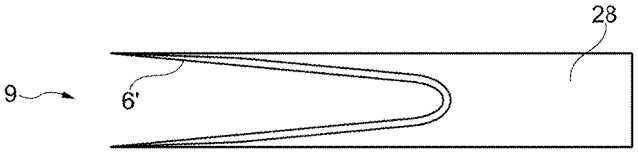
FIG. 13 shows a side view of a further embodiment of inserts for use in a tool.

In FIGS. 12 and 13, there are shown embodiments corresponding to FIGS. 10 and 11. However, these embodiments are shown with cutting edges 6 and 7, or 6' respectively, which have a significantly larger extension. This allows for a longer cutting edge having a cutting effect with higher reliability when cutting the net. The length of the rectilinear cutting edges 6,7 in the feed slot and, thus, also of the two side portions of the curved cutting edge 6' may be from about 20 mm to about 70 mm. The distance at the inlet opening of the feed slot 9 will be determined based on safety concerns, so that it prevents a hand getting into the feed slot. Therefore, the feed slot 9, typically, has a height at the inlet opening of less than 18 mm.

Figure 14:
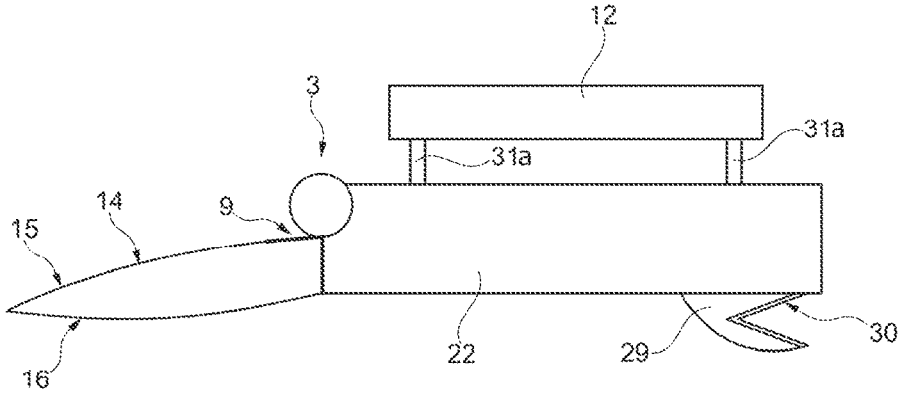
FIG. 14 shows a schematic view of a further embodiment of a tool.
Figure 15:
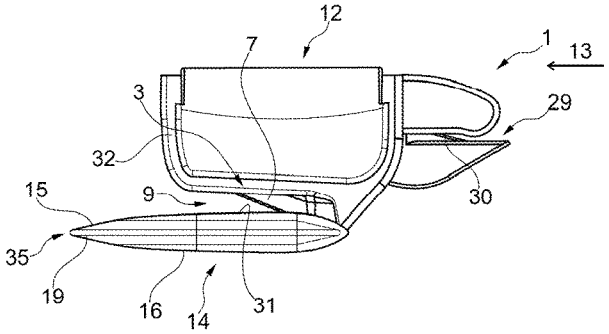
FIG. 15 shows a view of a further embodiment of a tool.
Figure 16:
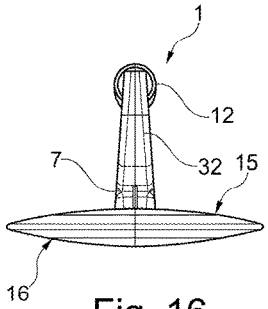
FIG. 16 shows a view of a further embodiment of a tool.
Figure 17:
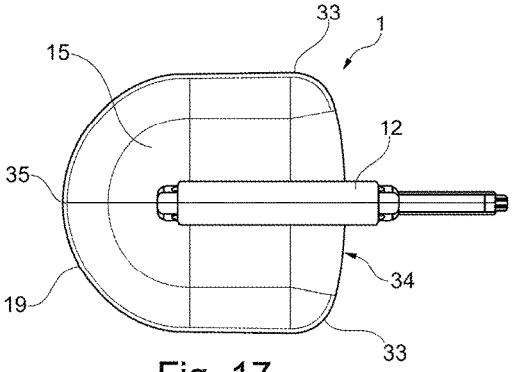
FIG. 17 shows a view of a further embodiment of a tool.
Figure 18:
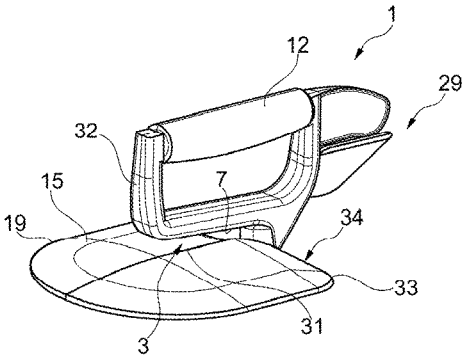
FIG. 18 shows a view of a further embodiment of a tool.

FIG. 14 shows a tool 1 in which the handle portion 12 is mounted above the housing 22 by two mounting pins 31*a*. A location of the handle portion 12 above the housing 22 provides good balance of the tool. Thus, a twist in the user's hand is reduced. Placing a handle portion 12, as shown in FIG. 14, can also be applied to the motorized embodiments as shown in FIG. 1 and FIG. 2. In this embodiment, at the underside of the housing, a knife 29 is mounted with a cutting blade 30 facing rearwards relatively to the tool's use when cutting a net. The knife 29 is used to make a hole in a net or to perform other cutting as locations where there is no possibility to establish a stretching of the net on the guiding member 14. This is particularly advantageous for making a hole in a net in a situation where the net is tightened at the base of a tree. Subsequently, the guiding member 14 is inserted into the hole and the cutting action can start. The cutting blade 30 is directed rearwards, so that there is no risk of getting caught during normal use of the cutting member 3.

FIGS. 15-18 show an image of a further tool 1 as seen from different angles.

In the tool of FIGS. 15-18, a recess 31 is provided in the first convex surface 15. The cutting edge 7, thus, extends above the first convex surface 15 as it is placed in the recess 31. At its upper side, the cutting blade 7 is connected to a holder 32 for the handle 12.

In this embodiment, the curved front edge 19 has a transition to the rear edge 34 in the form of rounded corners 33. The rear edge 34 is shown as curved in this embodiment. The rear edge 34 may alternatively be rectilinear. Further, in FIGS. 15 and 17, the reference numeral 35 indicates the forward end of the guiding member 14. The point 35, thus, constitutes the point which is at the front during a cutting operation where the tool is moved with the knife in a forward direction 13.

In the embodiment, as shown in FIGS. 15-18, there is provided a further knife member in the form of a knife 29. The knife 29 will, as mentioned above, be used for making a hole in the net before cutting commences with the guiding member 14 located between the product and the packaging.

The cutting edge 30 will also in this situation be directed rearwards with regard to the guided direction during the normal cutting motion. Thus there is no risk of it getting caught during normal use of the cutting member 3.

It is noted that the cutting direction of the blade 29 and the cutting blade 7 are mutually opposite.

Figure 19:
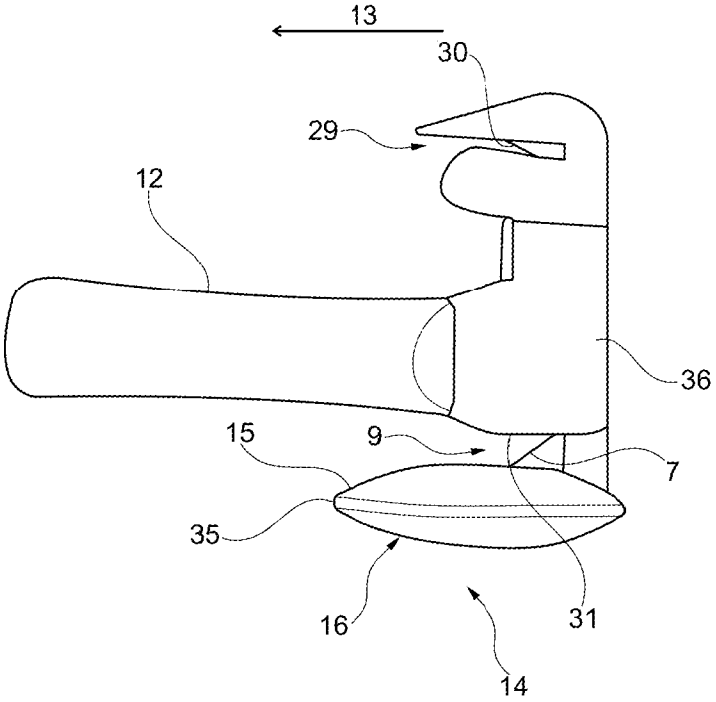
FIG. 19 shows a view of a further embodiment of a tool.
Figure 20:
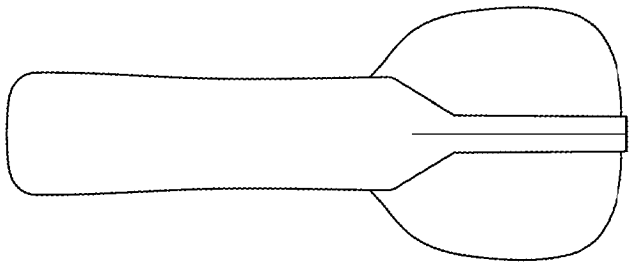
FIG. 20 shows a view of a further embodiment of a tool.
Figure 21:
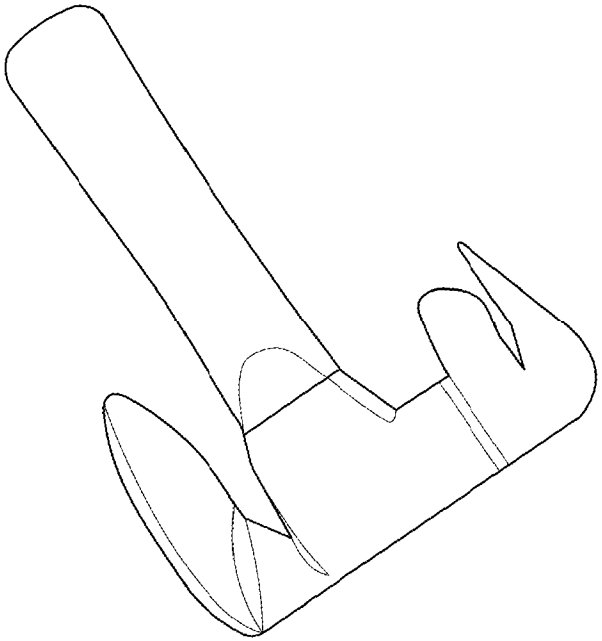
FIG. 21 shows a view of a further embodiment of a tool.

FIGS. 19-21 show a further embodiment of a cutting tool according to the invention, where a guiding member 14 has substantially the same shape as illustrated in FIGS. 15-18. That is, the cutting blade 7, also in this embodiment, is located in a recess in the first convex surface 15.

The handle with the handle portion 12 is positioned by a holder part 36 at the rear end of the guiding member 14. The holder part 36 is positioned upwards relatively to the upper side of the first convex surface 15. The handle portion 12 extends forward so that it is in a position above and in front of the cutting blade 7. The handle portion 12 extends farther away from the cutting blade 7 than the guiding member 14, making the pulling movement during the cutting easy. Also in this embodiment, a single cutting blade 7 co-operates with a counter-holder 31, which is provided at the underside of the handle portion 12.

In this construction, the further blade 29 is positioned above the cutting member 3 and the cutting blade 30 is directed forwards in the same direction as the cutting blade 7.

This tool will be used with a "pulling" movement of the handle portion 12 in the guiding direction 13, which also corresponds to the orientation of the handle portion 12.

The orientation of the handle portion 12 will in all embodiments correspond to the orientation of the arrow 13. The arrow 13 will also indicate the direction of movement that the tool during a normal cutting motion of the cutting blade third It is preferred that any embodiment of the tool is provided with a knife 29 that is suitable for breaking a packaging, such that there is provided an initial cut of the packaging.

Figure 22:
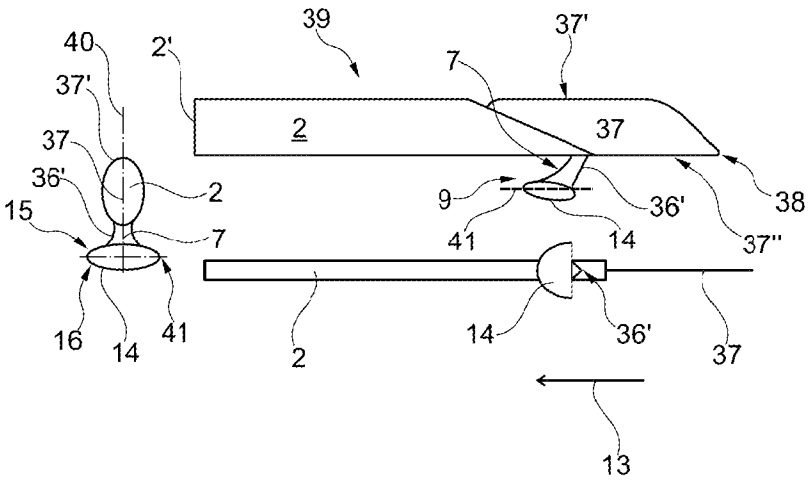
FIG. 22 shows a sketch of a tool suitable for use in slaughtering.

FIG. 22 shows a knife 39, intended for use in slaughtering, comprising a handle 2 in extension of a knife blade 37, wherein the knife blade 37 is provided with a pointed front part 38 and with a cutting knife edge 37' at one elongate side and a blunt edge 37" at the opposite elongate side of the knife blade 37. The knife blade 37 is suitable for breaking skin of an animal similar to the breaking that is done with the knife 29 of the embodiments described above. The knife blade 37 is also suitable for the general slaughter work. The handle 2 has a first end 2', which is opposite to the pointed front part 38, and a second, opposite end, which is closer to the pointed front part 38. On that side of the knife 39 that is opposite the cutting edge 37', there is provided a guiding member 14 on a holder part 36' as well as a cutting blade 7 extending at an acute angle from this side towards the guiding member 14 and in an oblique direction away from the pointed front part 38. Thereby the handle 2 and the cutting blade 7 form a feed slot 9 that is open in the direction towards the first end 2' of the handle 2. Also, this tool will then be used with a "pulling" movement of the handle 2, that is, in a direction with the first end 2' of the handle 2 at the lead during the movement.

As is apparent from FIG. 22, a portion of the handle 2 advances in extension of the blunt knife edge 37" such that the distance from the handle 2 along the blunt edge 37" of the knife blade 37 to the pointed front part 38 is shorter than the distance from the handle 2 to the pointed front part 38 along the cutting knife edge 37', for example at least 15% or at least 25% shorter than the length of the cutting knife edge 37'. There are also other options for providing the guiding member 14 on the knife 39. For example, guiding member 14 may be attached to the knife blade 37, for example attached to a holder part 36' that is molded onto the knife blade 37. In order to ensure that the holder part 36' is not sliding off the knife blade 37, the knife blade 37 may be provided with holes along the blunt edge 37" through which the polymer material of the holder part 36' is molded.

Such a knife 39 is advantageous in connection with slaughtering, where the blade knife 37 is used to cut a hole in an animal, especially the abdomen, and the guiding member 14 is inserted under the skin at the abdomen for raising the abdominal wall by pull in the handle 2 and simultaneously cutting it with the cutting blade 7 without risk of the intestinal wall being damaged by the cutting blade during cutting.

It is noted that the cutting knife edge 37' of the knife blade 37 is directed opposite to the cutting direction 13 of the cutting blade 7 by pulling the handle 2. The handle 2 extends farther away from the blade 7 in the cutting direction 13 than the guiding member 14, making the pulling movement during cutting easy and provides a good control of the tool during use.

In FIG. 22, the plane 40 containing the cutting blade 7 is indicated as a dotted line 40, and the center plane of the guiding member 14 is indicated by another dotted line 41, and it is noted that the two planes 40, 41 are perpendicular to each other.

A typical maximum length and maximum width of the guiding member 14 is 10-30 mm, for example 10-20 mm. The greatest thickness is typically 3-5 mm. Also in this case, the width and length is larger than the thickness and advantageously larger than several times the thickness, for example at least twice the thickness.

Although the present invention has been disclosed in the form of preferred embodiments and variations thereon, it will be understood that numerous additional modifications and variations could be made thereto without departing from the scope of the invention.

For the sake of clarity, it is to be understood that the use of "a" or "an" throughout this application does not exclude a plurality, and "comprising" does not exclude other steps or elements.

The invention claimed is:

1. A cutting tool including a handle and a cutting member for cutting or shearing a material, the cutting member comprising:

a feed slot provided between a cutting blade and a co-operating counter member, which for a cutting cooperation of the cutting blade and the co-operating counter member, an acute angle is formed therebetween;

a guiding member with a discus shape formed by two convex surfaces on either side of a central plane through the guiding member, wherein the central plane is perpendicular to a plane containing at least one of the cutting blade and the co-operating counter member;

wherein each of the two convex surfaces are bounded by a curved front edge and by a trailing edge that is a curved edge or a rectilinear edge, wherein the curved front edge and the trailing edge are approximately at least one of semi- and semi-oval-shaped, wherein at least the curved front edge is joined together;

wherein a recess is provided in an upper side of a first convex surface of the two convex surfaces, and in the recess, the cutting blade is arranged such that the cutting blade extends above the first convex surface, at least one of the cutting blade and the co-operating counter member being oriented with a cutting edge oriented towards a front end of the guiding member; and wherein the handle extends substantially parallel with the plane containing at least one of the cutting blade and the co-operating counter member and is positioned with an extension above a second convex surface of the two convex surfaces.

2. The cutting tool according to claim 1, wherein the handle is located above the feed slot.

3. The cutting tool according to claim 1, wherein the cutting edge of the cutting blade is pointing in a cutting direction, and the handle is provided in front of the cutting blade with respect to a cutting direction in order to facilitate use of the tool by a pulling movement.

4. The cutting tool according to claim 3, wherein the handle extends farther away from the cutting blade in the cutting direction than the guiding member.

5. The cutting tool according to claim 1, further comprising an additional knife member of the cutting tool, the additional knife being placed without co-operation with the cutting blade.

6. The cutting tool according to claim 5, wherein the handle is elongate, and the additional knife member is an elongate knife blade in extension of said elongate handle; wherein the elongate knife blade is provided with a cutting knife edge and has a front end farthest away from the handle and an opposite end that is attached to the handle; wherein the guiding member is provided at a side that is opposite the cutting knife edge.

7. The cutting tool according to claim 6, wherein the guiding member is provided on a holder part, and there is provided the cutting blade extending at an acute angle from this side in an oblique direction away from a front end and forms the feed slot between the guiding member and the handle.

8. The cutting tool according to claim 1, wherein the two convex surfaces have a largest width and length of between 10 and 30 mm.

9. The cutting tool according to claim 1, wherein the two convex surfaces have a maximum width of between 20 mm and 250 mm, a maximum length of between 30 mm and 300 mm, and a maximum height of between 10 mm and 50 mm measured at the largest distance between the two convex surfaces.

10. The cutting tool according to claim 1, wherein the two convex surfaces have rounded corners between the curved front edges and the rear edges.

11. The cutting tool according to claim 1, wherein the guiding member has a length and a width that is several times a thickness.

12. The method for using a cutting tool according to claim 1, the use comprising removing nets from Christmas trees, unpacking of packaged products, or slaughtering of animals.

13. A cutting tool including a handle and a cutting member for cutting or shearing a material, the cutting member comprising:

a feed slot provided between a cutting blade and a co-operating counter-cutting blade, which for a cutting cooperation of the cutting blade and the co-operating counter-cutting blade, an acute angle is formed therebetween;

a guiding member with a discus shape formed by two convex surfaces on either side of a central plane through the guiding member, wherein the central plane is perpendicular to a plane containing at least one of the cutting blade and the co-operating counter-cutting blade;

wherein each of the two convex surfaces are bounded by a curved front edge and by a trailing edge that is a curved edge or a rectilinear edge, wherein the curved front edge and the trailing edge are approximately at least one of semi- and semi-oval-shaped, wherein at least the curved front edge is joined together;

wherein a recess is provided in an upper side of a first convex surface of the two convex surfaces, and in the recess, the cutting blade is arranged such that the cutting blade extends above the first convex surface, at least one of the cutting blade and the co-operating counter-cutting blade being oriented with a cutting edge oriented towards a front end of the guiding member; and wherein the handle extends substantially parallel with the plane containing at least one of the cutting blade and the co-operating counter-cutting blade and is positioned with an extension above a second convex surface of the two convex surfaces.

14. The cutting tool according to claim 13, wherein the handle is located above the feed slot.

15. The cutting tool according to claim 13, further comprising an additional knife member of the cutting tool, the additional knife being placed without co-operation with the cutting member.

16. The cutting tool according to claim 13, wherein the two convex surfaces have rounded corners between the curved front edges and the rear edges.

17. The method for using a cutting tool according to claim 13, the use comprising removing nets from Christmas trees, unpacking of packaged products, or slaughtering of animals.

18. A cutting tool including a handle and a cutting member for cutting or shearing a material, the cutting member comprising:

a feed slot provided between two cooperating cutting blades, which for a cutting cooperation of the two cooperating cutting blades, an acute angle is formed therebetween;

a guiding member with a discus shape formed by two convex surfaces on either side of a central plane through the guiding member, wherein the central plane is perpendicular to a plane containing at least one of the two cutting blades and the co-operating counter member;

wherein each of the two convex surfaces are bounded by a curved front edge and by a trailing edge that is a curved edge or a rectilinear edge, wherein the curved front edge and the trailing edge are approximately at least one of semi- and semi-oval-shaped, wherein at least the curved front edge is joined together;

wherein a recess is provided in an upper side of a first convex surface of the two convex surfaces, and in the recess, the two cutting blades are arranged such that at least one of the two cutting blades extends above the first convex surface, at least one of the two cutting blades being oriented with a cutting edge oriented towards a front end of the guiding member; and wherein the handle extends substantially parallel with the plane containing at least one of the two cutting blades and is positioned with an extension above a second convex surface of the two convex surfaces.

19. The cutting tool according to claim 1, wherein the handle is located above the feed slot.

20. The method for using a cutting tool according to claim 18, the use comprising removing nets from Christmas trees, unpacking of packaged products, or slaughtering of animals.

* * * * *